US010647110B2

(12) United States Patent
Muehl et al.

(10) Patent No.: US 10,647,110 B2
(45) Date of Patent: May 12, 2020

(54) DETERMINATION OF THRESHOLDS TO DETECT MISSING PRINTING NOZZLES

(71) Applicant: HEIDELBERGER DRUCKMASCHINEN AG, Heidelberg (DE)

(72) Inventors: Johannes Muehl, Heidelberg (DE); Hans Koehler, Edingen-Neckarhausen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 16/155,925

(22) Filed: Oct. 10, 2018

(65) Prior Publication Data

US 2019/0105895 A1 Apr. 11, 2019

(30) Foreign Application Priority Data

Oct. 10, 2017 (DE) ..... 10 2017 217 993

(51) Int. Cl.
*B41J 2/045* (2006.01)
*B41J 2/21* (2006.01)

(52) U.S. Cl.
CPC ..... *B41J 2/0451* (2013.01); *B41J 2/04586* (2013.01); *B41J 2/2139* (2013.01); *B41J 2/2142* (2013.01); *B41J 2/2146* (2013.01)

(58) Field of Classification Search
CPC .... B41J 2/0451; B41J 2/04586; B41J 2/2146; B41J 2/2142; B41J 2/2139
See application file for complete search history.

(56) References Cited

U.S. PATENT DOCUMENTS

| | | | |
|---|---|---|---|
| 7,101,011 B2 | 9/2006 | Koitabashi et al. | |
| 7,201,462 B2 | 4/2007 | Shibata et al. | |
| 8,646,869 B2 | 2/2014 | Yamazaki | |
| 2013/0100189 A1 | 4/2013 | Azuma et al. | |
| 2016/0347081 A1 | 12/2016 | Fukasawa | |
| 2018/0086049 A1* | 3/2018 | Ueshima | B41J 2/2139 |

FOREIGN PATENT DOCUMENTS

| | | |
|---|---|---|
| DE | 60206123 T2 | 6/2006 |
| DE | 60302188 T2 | 7/2006 |
| DE | 102016224303 A1 | 6/2018 |
| EP | 2505364 A2 | 10/2012 |

* cited by examiner

*Primary Examiner* — Bradley W Thies
(74) *Attorney, Agent, or Firm* — Laurence A. Greenberg; Werner H. Stemer; Ralph E. Locher

(57) ABSTRACT

A method detects defective printing nozzles in an inkjet printing machine having a computer. The method includes printing a multi-row nozzle test chart for detection purposes, the test chart contains a number of horizontal rows of equidistant vertical lines printed periodically and disposed underneath one another. Wherein in every row of the nozzle test chart periodically only those respective printing nozzles of the print head contribute to the first element of the nozzle test chart that correspond to the specified number of the horizontal rows. An area coverage element geometrically associated with the nozzle test chart is printed. Both elements are recorded by an image sensor and both elements are evaluated by the computer. Defective printing nozzles are identified by evaluating the recorded nozzle test chart by the computer. Defects are allocated in the area coverage element to the printing nozzles in the nozzle test chart by the computer.

9 Claims, 4 Drawing Sheets

DETERMINATION OF THRESHOLDS TO DETECT MISSING PRINTING NOZZLES

CROSS-REFERENCE TO RELATED APPLICATION

This application claims the priority, under 35 U.S.C. § 119, of German application DE 10 2017 217 993.7, filed Oct. 10, 2017; the prior application is herewith incorporated by reference in its entirety.

BACKGROUND OF THE INVENTION

Field of the Invention

The present invention relates to the determination of thresholds for a method for detecting defective printing nozzles.

The technical field of the invention is the field of digital printing.

In digital printing, namely in inkjet printing, the malfunctioning of individual printing nozzles of the print head of the inkjet printing machine is a common phenomenon. Nozzle malfunctions can take many forms: a nozzle may print at a reduced ink drop volume; the print dot of the printing nozzle may deviate, i.e. the nozzle prints at an angle; a nozzle may fail completely. Foreign bodies, in particular dust particles, that have entered the printing nozzle or hardened ink residues in a printing nozzle of the print head are examples of common causes of such malfunctions. All these different types of malfunctions of defective printing nozzles are referred to by the generic term of "missing nozzle". Such missing nozzles result in specific defects in the print to be created. A failed printing nozzle for instance causes a line-shaped artifact because no ink is applied at the respective location. In a monochrome print, what is known as a "white line" is created at the location of the defective printing nozzle because the printing substrate, which is white in most cases, shines through. In a multicolor print, where the inkjet printing machine prints multiple colors on top of one another to obtain a specific color value, the target color value is distorted because the failed printing nozzle does not contribute its designated color proportion. Printing nozzles that print with a reduced ink volume have a similar effect. Printing nozzles that print with a large angular offset create an additional problem: In addition to a white line that is created because the printing nozzle does not print at the designated location, a black line is created because the large angular offset causes the printing nozzle to print at a location that already receives ink from another printing nozzle. Due to the increased amount of ink that is applied at this location, a line-shaped artifact is created whose color value is higher than actually intended. This is referred to as a "black line".

To minimize the effects that such printing nozzle malfunctions have on the quality of the print, various methods for compensating for such defective printing nozzles have been applied. However, the first step necessary to be able to take compensatory steps, is to accurately identify the defective printing nozzle. Different approaches have become known in the art to detect such defective printing nozzles. One known approach, for instance, is to provide an image sensor for recording the print that has been created by the inkjet printing and to compare the print that has been digitized in this way to an reference image to be able to detect deviations that may be caused by defective printing nozzles. However, this approach, which is mostly carried out in an automated quality control process, suffers from a variety of problems. For instance, it allows only those printing nozzles to be monitored that actually contribute to the creation of the respective print. Thus printing nozzles that are not needed for a current print job cannot be monitored to find malfunctions. In addition, in many cases, the print image data that are to be created in preparation of the print job are unsuitable for an accurate functional check of an individual printing nozzle. Another problem is the allocation of an image defect in the recorded print to a specific printing nozzle. Due to restrictions of the image recording system such as the resolution of the image sensor that is used, such an allocation—albeit essential for a correct functional monitoring of the individual printing nozzles—is only possible to a limited extent.

A common method for detecting defective printing nozzles is to print what are referred to as nozzle test charts, which are placed and printed onto the printing substrate outside the actual print. Such nozzle test charts are recorded by the image recording system and evaluated. Since the nozzle test chart has been configured with the specific intention of allocating a specific part of the test chart to every printing nozzle, an evaluation of the recorded nozzle test chart provides unequivocal information on the functioning of all contributing printing nozzles. The evaluation is made in a computer-assisted way and is usually implemented by the computer of the respective image recording system. However, it is possible to forward the data to a specific evaluation computer. The known nozzle test charts themselves vary considerably. One chart known in the art consists of a vertical line printed by every printing nozzle. Since the resolution of the image sensor that records the nozzle test chart is often lower than the resolution of the print head, the nozzle test chart is mostly arranged in a way that only every xth nozzle in a row of adjacent nozzles on the print head prints a vertical line rather than every printing nozzle in a row. Subsequently, every (x+1)th printing nozzle of the row underneath prints a vertical line and so on until all printing nozzles that need to be tested on the print head have printed their respective vertical line. Due to the countability and unambiguousness of individual vertical lines, every single line may be allocated to a specific printing nozzle. For the evaluation, conclusions on the status of the printing nozzle in question may be drawn from parameters such as the degree of deviation of the line from the known target position thereof or the continuity of the printed line. A disadvantage of this approach is, however, that it is difficult to correlate the degree of deviation of the printing nozzle from the target position and the extent to which the nozzle will be responsible for a typographic defect in the final print if at all. Thresholds for evaluating whether the printing nozzle prints in an acceptable functional range or needs to be classified as defective are used for this purpose. If a threshold for evaluating whether a printing nozzle is defective or not is set to be too sensitive, many errors of judgment may be the consequence, i.e. printing nozzles that operate correctly and have a small deviation but are still suitable for printing would be recognized as defective and would later be compensated for. Yet printing nozzle compensations will always result in lower print quality in the print to be created than a print that is created with a complete set of functioning printing nozzles. If, on the other hand, a threshold is too lax, the nozzles that are typographically problematic and cause defects in the print are not recognized, remain uncompensated for, and continue to create defects in the print.

The defined threshold may be a constant value. However, an expedient threshold depends on the current printing conditions such as the ink flow behavior, which in turn depends on the substrate that is printed on and on the ink dryer settings, for instance. In addition, the measuring system that records the nozzle chart (camera system) may create measuring noise, which applies an error to a theoretically assumed value of the threshold (e.g. a deviation in the x direction by one half of the width of the nozzle writing range). Thus a definition of a constant value is difficult both from the measurement technology perspective and from the perspective of varying printing conditions.

A statistical value derived from the measured values of all nozzles may be taken as an alternative threshold. This may be n times the standard deviation of the deviation of the nozzle from the target position in the x direction, for instance. Such a threshold causes nozzles that clearly print in a way that is different from the other nozzles to be classified as problematic. A nozzle may for instance be classified as problematic if the deviation from the target position is greater than 4 times the standard deviation of all deviations of all nozzles from the target position in the x direction. A disadvantage of this process is that it assumes a functioning set of nozzles in which all nozzles that have values below the criterion of n times the standard deviation do not cause any typographic defects under the current printing conditions. Yet if many nozzles of the set no longer function because of a considerable localized contamination, the threshold defined as n times the standard deviation will be higher than the values of many nozzles that no longer function. These nozzles will then not be recognized as problematic.

Thus it is known in the art to print area coverage elements instead of nozzle test charts. In such a case, all contributing printing nozzles print a halftone or solid area for test purposes. Then the image is recorded to check whether the area coverage element that has been printed contains image artifacts such as white lines, black lines, or the like that indicate printing nozzles that do not function correctly. This approach is very useful for a general detection of printing nozzles that cause problems in the print. But as it is the case with the detection on the basis of the actual printed image, again this process is faced with the inherent problem that the individual printing nozzles that cause these defects cannot be identified within the area coverage element. It is only possible to identify the region in which the defective printing nozzle must be located but not the individual specific printing nozzle itself that is defective. The latter would only be possible if a high-performance image recording hardware of high image recording resolution was provided. Even then, due to the ink flow behavior, it may only be the defect that is identifiable. In this case it remains impossible to identify the specific nozzle because there is no unequivocal correlation between the visible defect in the area and a specific nozzle. In a similar way, the failure of a nozzle pair or of special nozzles in a neighborhood range may only be detected by means of a camera of extremely high resolution, if they are not altogether impossible to detect.

Published, non-prosecuted German patent application DE 10 2016 224 303.9, which has not yet been published, discloses to print the area coverage elements in addition to the nozzle test chart with multiple different area densities. If a deviating nozzle is found in the course of the evaluation of the nozzle test chart, the corresponding position in the area coverage elements of different area densities may be checked to see whether the specific defective printing nozzle causes print defects and if so at what area densities. Compensatory measures will then be taken only for area densities at which the defective printing nozzle causes defects in the print. However, a disadvantage of this approach is that for an accurate assessment and categorization of a printing nozzle with print deviations that has been detected in the nozzle test chart, the area coverage element with the various area densities always needs to be printed onto the printing substrate. Since the image is continuously recorded during the production run on the inkjet printing machine for quality control purposes including the detection of defective printing nozzles, this means that the nozzle test chart and in this case the area coverage element at multiple area densities need to be printed onto every xth print sheet. This means that a considerably increased effort is required for the entire detection process. For it is not only the nozzle test chart that needs to be evaluated but also the area coverage element with multiple area densities, and both results continuously need to be compared to one another. In addition, this method of the prior art does not give any information on how to solve the problem of determining accurate thresholds for evaluating every single nozzle that exhibits deviations in the nozzle test chart.

Another document of the prior art is European patent application EP 25 05 364 A2, corresponding to U.S. Pat. No. 8,646,869, which discloses a method for determining printing nozzles that exhibit print deviations and involves the definition of thresholds for assessing when a printing nozzle exhibits print deviations. This method of the prior art does not disclose the printing of an area coverage element. Instead, the thresholds are defined exclusively from the detection and evaluation of printed nozzle test charts. Thus these methods continue to suffer from the disadvantage that the thresholds for evaluating a deviation of the printing nozzle are defined without considering the actual print result. This means that due to potentially erroneous thresholds, these methods likewise run the risk of detecting deviations that do not actually create any visible print defects and consequently do not affect the print quality of the printed product to be created.

SUMMARY OF THE INVENTION

Thus the object of the present invention is to provide a method for detecting defective printing nozzles that is more efficient and requires less effort than the known methods of the prior art.

The object is attained by a method for detecting defective printing nozzles in an inkjet printing machine having a computer. The method includes the steps of printing a multi-row nozzle test chart for detection purposes with only every nth printing nozzle active per row x and the respective (n+1)th printing nozzle active in every further row x+1 printing an area coverage element geometrically associated with the nozzle test chart. Both elements are recorded by means of at least one image sensor. Both elements are evaluated by means of the computer. Defective printing nozzles are identified by evaluating the recorded nozzle test chart by means of the computer. Defects are allocated in the area coverage element to printing nozzles in the nozzle test chart by means of the computer. Parameters of the allocated printing nozzles are allocated in the nozzle test chart as a function of the defects in the area coverage element by means of the computer, the parameters defining a range of values from which the computer derives thresholds for every allocated printing nozzle, and using the thresholds for detecting defective printing nozzles. The method is characterized in that the allocation of detected defects in the area coverage element by the computer is achieved on the basis of deviations at a corresponding location transverse to the printing direction in the nozzle test chart. The printing nozzles in the nozzle test chart that are allocated to the detected defects are always those that, under consideration of the parameters to be evaluated, are most likely to cause the defect. The crucial aspect of the method of the invention is that an area element and a nozzle test chart are printed in such a way that they are geometrically positioned relative to one another. Positioned relative to one another means that every nozzle test chart element that is printed by a single nozzle may be allocated to a specific region in the area coverage element. The first step in a computer-assisted evaluation of the two test elements is to check the recorded and digitized image of the area coverage element for potential print defects. This may for instance be done by a comparison between the digital area coverage element and a reference image that is likewise available in a digital form, for instance from pre-print data. The digital reference image may be generated by a learn-in process as the printing machine is set up. However, since the area coverage element merely consists of a halftone or solid tone image without any particular structures, from a waste-reducing point of view it makes more sense to fall back on an image that has been digitally generated from pre-print data. Now if print defects are detected in the recorded and digitized area coverage element, the geometrically corresponding locations in the nozzle test chart are checked to see whether image elements of printing nozzles that may be responsible deviate in a corresponding way. If such printing nozzles that exhibit printing deviations are detected in the nozzle test chart, a range of values may be defined for the parameters that define the extent of the deviation. This range of values is then in turn used to define thresholds for evaluating the performance of the printing nozzle in question. In this way, a set of thresholds may be defined for the parameters that define the extent of the deviation and may then be used to determine the point at which a printing nozzle is defective and up to which it is not to be considered defective as a function of actually visible print defects. If no unequivocal allocation of a defect in the area coverage element to a specific printing nozzle in the nozzle test chart is possible, the computer chooses the printing nozzle in the nozzle test chart that is most likely to have caused the detected defect in the area coverage element. For instance, if a defect in the form of a white line is detected, but both a failed printing nozzle and a printing nozzle that prints at an angle are detected in the nozzle test chart, the failed printing nozzle is most likely to be mainly responsible for the defect rather than the printing nozzle that jets at an angle because the defect symptoms of a printing nozzle that jets at an angle are a white line plus a black line. In the reverse case, i.e. when a white line immediately next to a black line is discovered, the printing nozzle that jets at an angle is responsible and not the failed printing nozzle.

Advantageous and thus preferred further developments of the method will become apparent from the associated dependent claims and from the description together with the associated drawings.

A preferred further development of the method of the invention in this context is that the steps of printing and evaluating the area coverage elements are only carried out to calculate the thresholds during a set-up phase of the inkjet printing machine, whereas during a subsequent production run of the inkjet printing machine, only the nozzle test chart is printed and evaluated by the computer based on the application of the calculated thresholds. An obvious advantage of the method of the invention over the prior art methods is that the area coverage element is only printed during the set-up phase in which the thresholds for assessing whether printing nozzles are defective or not are defined. In the subsequent production run in which the prints are produced, it is sufficient to print only the nozzle test chart and to evaluate it for missing nozzle detection. Since the thresholds for determining whether a printing nozzle is defective or not have been defined during the set-up phase as a function of the visibility of defects in the area coverage element, the effort of printing and evaluating the area coverage element is no longer necessary during the production run.

A further preferred further development of the method of the invention in this context is that the evaluated parameters of the allocated printing nozzles from which the computer defines the range of values comprise the extent of a deviation of the line from a target position of the printing nozzle and/or the continuity of the equidistant vertical line printed periodically. These are the most important parameters for assessing the performance of a printing nozzle. The extent of the deviation of the line from the target position tends to refer to the potential defect caused by a printing nozzle that jets at an angle whereas the continuity of the printed line tends to refer to the volume of ink that is jetted by the printing nozzle in question.

A further preferred further development of the method of the invention in this context is that in a direction transverse to the printing direction, the printed area coverage element has the same width as the nozzle test chart and is printed underneath or above the nozzle test chart in the printing direction. For an accurate functioning, the geometric positioning of the nozzle test chart and the area coverage element needs to ensure that both elements have the same width because this is the only way for them to be capable of covering an identical region of the printing nozzles to be tested. To make it easier to allocate defects that occur in the area coverage element to specific nozzles in the nozzle test chart, the two should be printed so as to immediately follow one another on the printing substrate. What is printed first in the printing direction, the area coverage element or the nozzle test chart, is a secondary consideration. The only important thing is that they are printed close to one another in a way to allow them to be recorded by the image sensor of the image recording system in such a way that both elements occur within one image of the image sensor if at all possible. Although it is possible to position the two test elements slightly further apart from one another on the printing substrate, it may in this case become necessary to have the two elements recorded by different image sensors and/or in different images, which means that they need to be combined at a later point. This results in another potential error source and may make it difficult to allocate defects to defective nozzles.

A further preferred further development of the method of the invention in this context is that the calculation of the thresholds for detecting defective printing nozzles is carried out individually for qualified printing conditions such as the drying behavior of the inks that are used and/or the flow behavior of the ink on a sprinting substrate, as well as for specific settings of the inkjet printing machine. The defined thresholds only apply to the current print job at the qualified printing conditions that are specific to the print job. These qualified printing conditions contain criteria such as the drying behavior of the ink that is used or the flow behavior of the ink on a specific printing substrate that is used. The settings that are used on the specific inkjet printing machine are important for the calculated thresholds. As a logical consequence, for every new print job that has different qualified printing conditions, the thresholds need to be redefined. After all, it does not make much sense to use the same thresholds for different print jobs with correspondingly different qualified printing conditions and thus to run the risk of false negatives (defective printing nozzles that are not detected) or false positives (printing nozzles that operate correctly but are identified as defective).

A further preferred further development of the method of the invention in this context is that the calculated thresholds for detecting defective printing nozzles are saved for the specific qualified printing conditions and settings of the inkjet printing machine in a database that the computer may access. To ensure that the calculated thresholds are only applied to the current print job or similar print jobs with similar qualified printing conditions, they are saved in a database. Of course, the calculated thresholds are saved in conjunction with the qualified printing conditions of the print job in question to allow these values to be retrieved in the case of a repeat job or a job with similar qualified printing conditions.

A further preferred further development of the method of the invention in this context is that the detection method is run by a software qualification tool that is active on the computer and configures the substrate and print settings for a print job on the inkjet printing machine in a qualification phase. Since the detection process is preferably carried out during a first set-up phase of the inkjet printing machine and since only the nozzle test chart is printed and evaluated during the subsequent production run, is makes sense to implement the method for calculating the thresholds in an integrated way as part of a set-up software, which carries out the qualification of the printing substrate and print settings that are used in an automated way in the form of a wizard. Since this wizard specifies print criteria such as the qualified printing conditions anyway, integrating the method of the invention for determining the thresholds for the detection process means a much reduced effort compared to a separate implementation of the method of the invention.

A further preferred further development of the method of the invention in this context is that the detected defective printing nozzles of the inkjet printing machine are compensated for by a corresponding actuation of the inkjet printing machine. Then the possible compensation methods for the specific type of printing nozzle defect that has been detected may be applied to the defective printing nozzles that have been determined using the thresholds that have been defined in accordance with the invention.

The invention as such as well as further developments of the invention that are advantageous in constructional and/or functional terms will be described in more detail below with reference to the associated drawings and based on at least one preferred exemplary embodiment. In the drawings, mutually corresponding elements have the same reference symbols.

Other features which are considered as characteristic for the invention are set forth in the appended claims.

Although the invention is illustrated and described herein as embodied in a determination of thresholds to detect missing printing nozzles, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
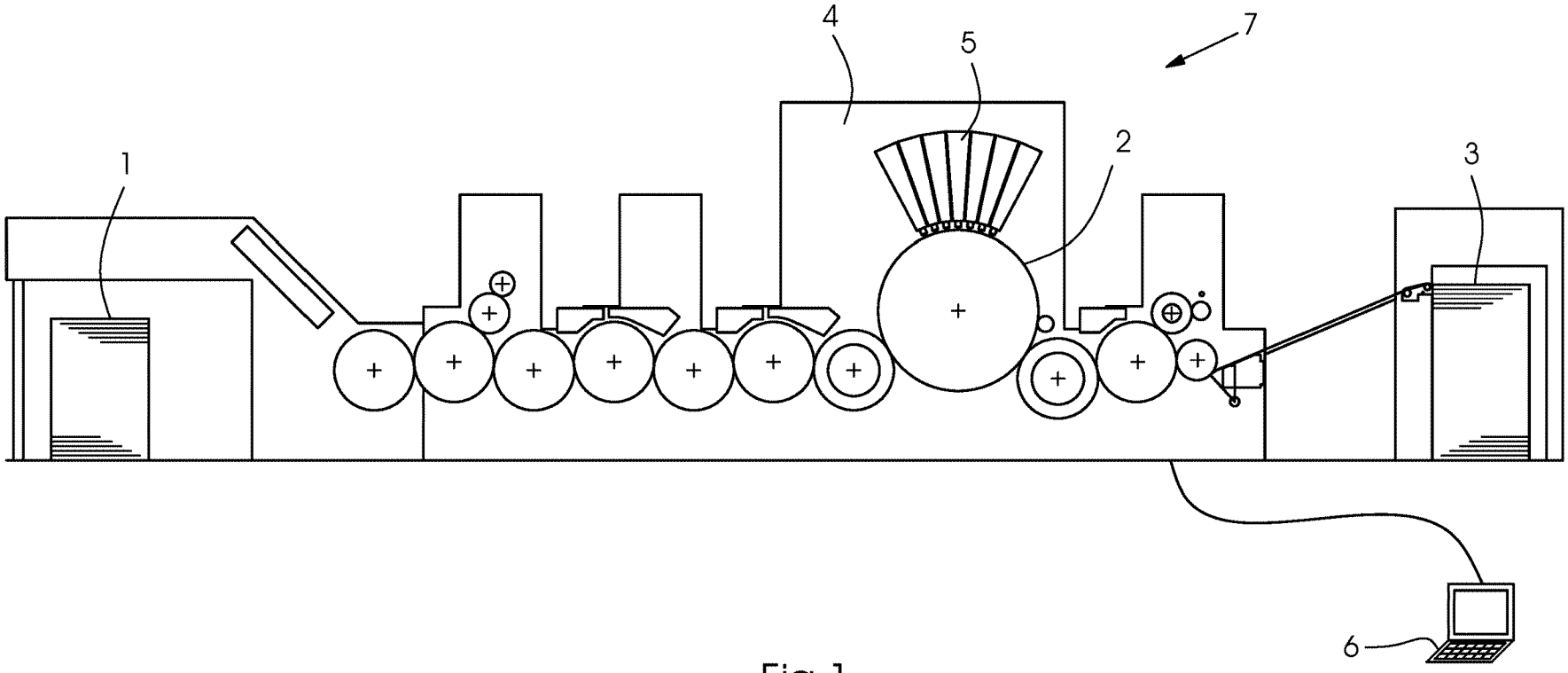
FIG. 1 is an illustration of a configuration of a sheet-fed inkjet printing machine.
Figure 2:
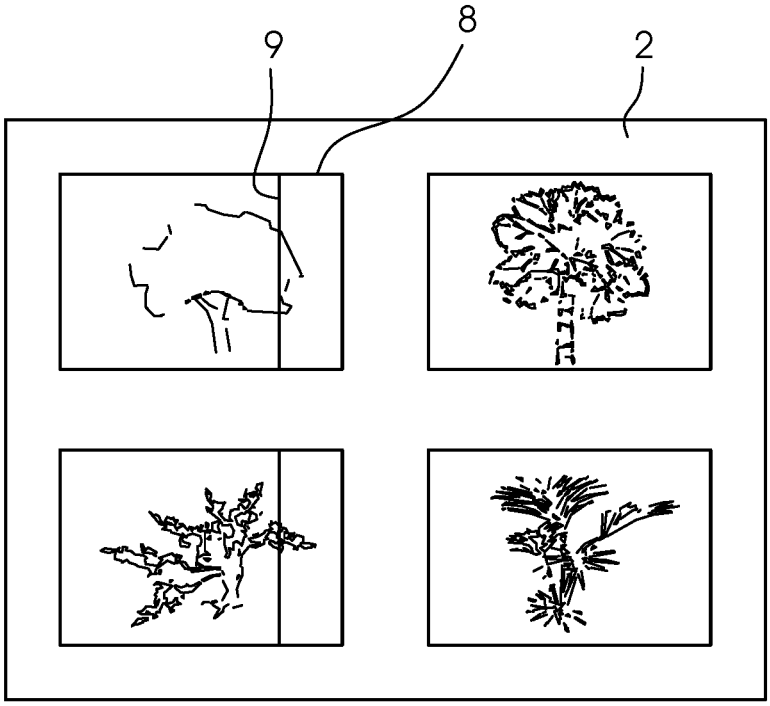
FIG. 2 is an illustration of a schematic example of a white line caused by a missing nozzle.

Referring now to the figures of the drawings in detail and first, particularly to FIG. 1 thereof, there is shown a field of application of a preferred exemplary embodiment of an ink jet printing machine 7. FIG. 1 shows an example of a fundamental configuration of the machine 7, including a feeder 1 for feeding the printing substrate 2 to the printing unit 4, where it receives an image printed by print heads 5, and a delivery 3. The printing machine is a sheet-fed inkjet printing machine 7 controlled by a control unit 6. While the printing machine 7 is in operation, individual printing nozzles in the print heads 5 in the printing unit 4 may fail as described above. Such a failure results in white lines 9 or, in the case of multicolor printing, in distorted color values. An example of such a white line 9 in a printed image 8 is shown in FIG. 2.

Figure 3:
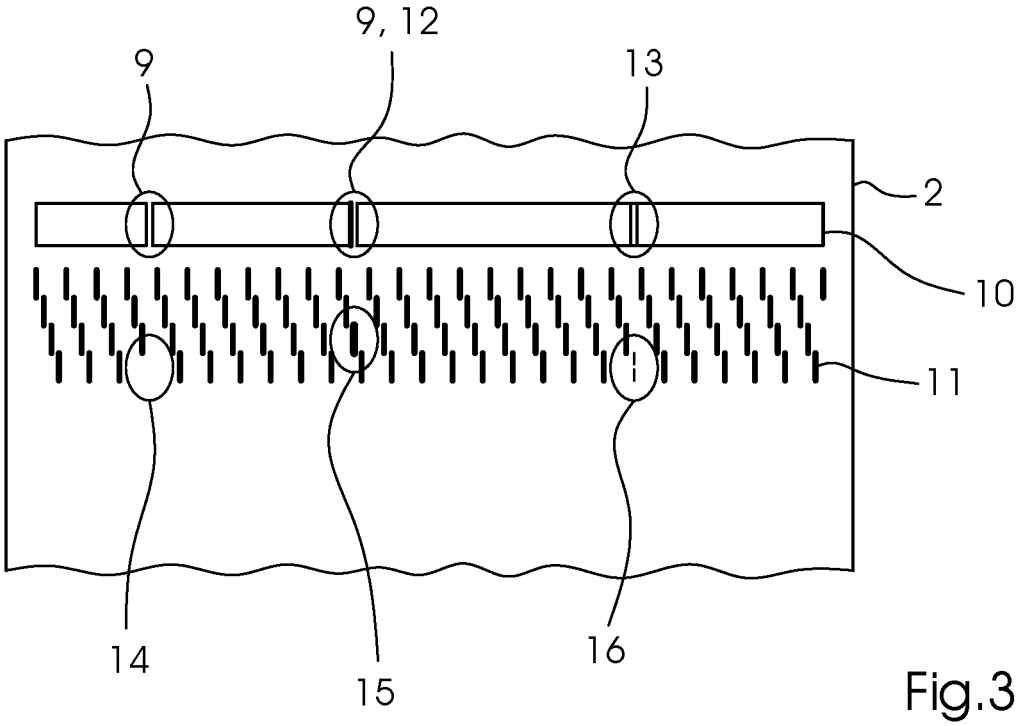
FIG. 3 is an illustration of an area coverage element and an associated nozzle test chart for determining thresholds that have been printed during the set-up phase of the printing machine.
Figure 5:
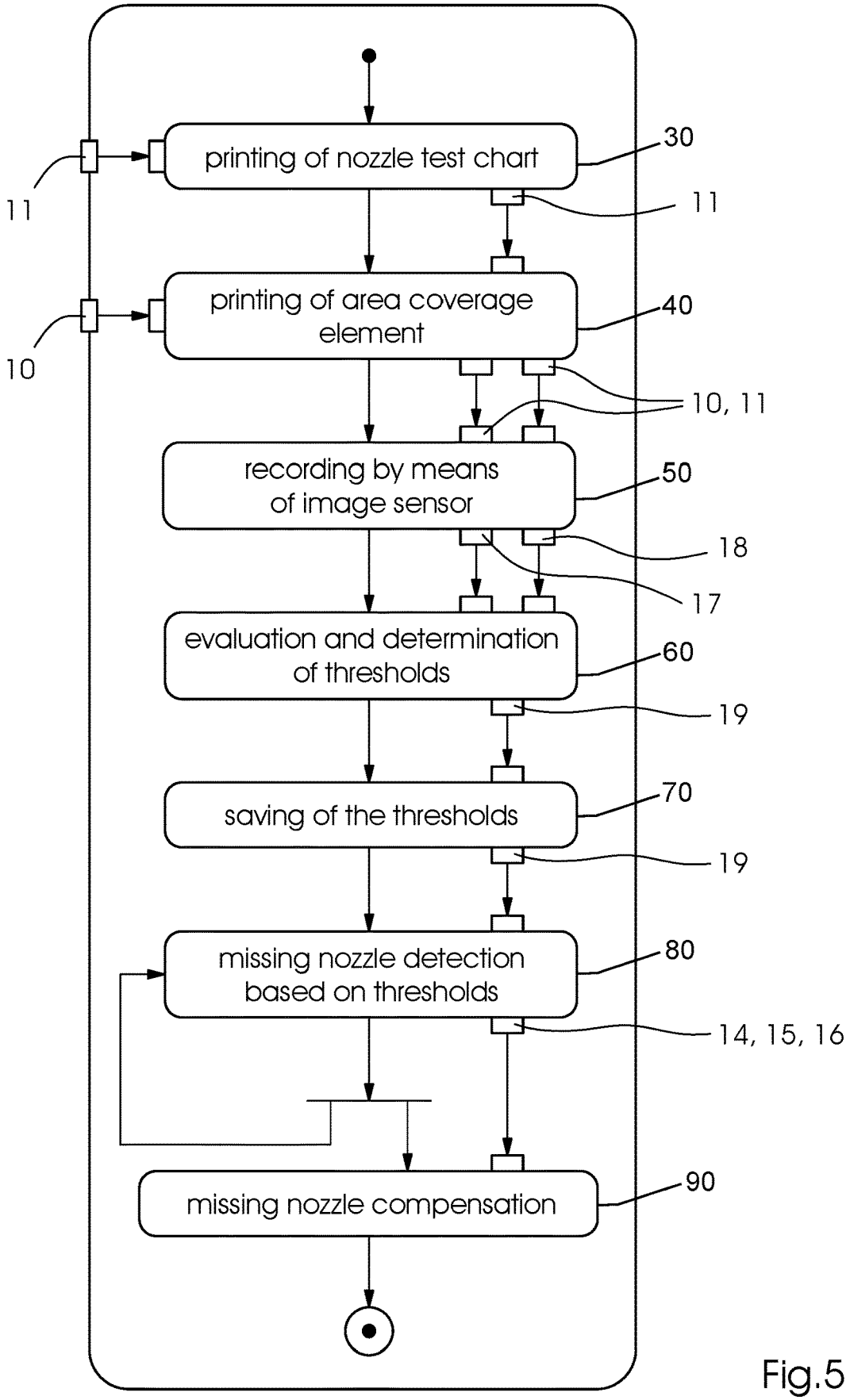
FIG. 5 is a schematic flow chart of a method of the invention.

FIG. 5 is a schematic flow chart of a preferred embodiment of the method of the invention. In the course of a substrate learn-in phase, measurements of nozzle characteristics are taken when a nozzle test chart 11 is printed, step 30. In the nozzle test chart, every nozzle generates a line that is separately created by the respective nozzle. The measurements include the position of the line relative to the target position of the line, for instance. At the same time as the nozzle test chart 11, an element 10 is printed, step 40. The element 10 includes an area in which nozzle defects 14, 15, 16 become recognizable in visible print artifacts 9, 12, 13. This means that the two methods of the prior art are implemented in combination. Due to their geometric arrangement below one another in the printing direction, the two elements 10, 11 make the regions of identical contributing nozzles approximately allocable (within the limits of the resolution of the image recording system). An example of such an arrangement is shown in FIG. 3. FIG. 3 shows that a missing printing nozzle 14 results in a white line 9 in the area coverage element 10 in the nozzle test chart 11. A printing nozzle that exhibits a deviating print dot 15, i.e. a nozzle 15 that jets at an angle, results in a white line 9 immediately adjacent to a black line 12. A printing nozzle 16 that prints a reduced amount of ink results in a strip-shaped image artifact 13.

The printing operation occurs at the printing conditions and settings qualified for the printing substrate 2, i.e. the settings that determine the print result such as the drying of the ink or the flow behavior of the ink on the substrate 2 are accurately set. Then the printed elements 10, 11 are recorded by the image recording system and digitized, step 50. The digital elements 17, 18 that have been recorded in this way are forwarded to the evaluation computer 6 for further evaluation, step 60. Based on the geometric arrangement, the typographically problematic areas that are visible in the area coverage element 10 are then allocated to nozzles in the nozzle test chart 11. If the allocation is not unequivocal, a nozzle with values that clearly deviate from the target value is selected in the nozzle test chart 11. This is done for all visible artifacts 9, 12, 13 in the area coverage element 10. The result is a representative set of nozzles in the chart 11 that are known to be typographically problematic at the current print settings. The measured values of these nozzles in the nozzle test chart 11 now define a range of values that correlates directly with the printing problem without the need for estimating thresholds 19. Thus a threshold 19 per nozzle criterion (deviation from the target position, continuity of the line, line smearing) is defined for these printing conditions and settings qualified on the substrate 2. This threshold may be saved in a substrate database, step 70. The required thresholds 19 for assessing the performance of the printing nozzles are calculated in this way.

Figure 4:
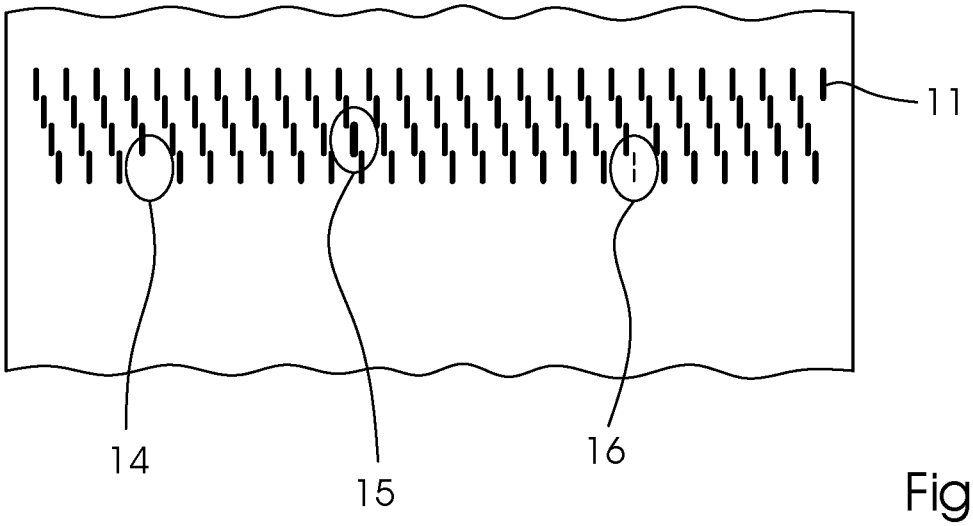
FIG. 4 is an illustrates the nozzle test chart with calculated thresholds that has been printed during the production run.

To detect missing nozzles only those nozzle test charts 11 with which unequivocal nozzle identification is possible are printed in the framework of the regular printing process when the printing conditions are activated, step 80. Such a nozzle test chart exclusively for nozzle testing is shown in FIG. 4. To evaluate the nozzle test chart 11, the thresholds 19 saved in the database in connection with the respective printing conditions are used for analysis purposes: the calculated thresholds 19 ensure that only nozzles 14, 15, 16 that cause typographic problems are detected. Only these printing nozzles 14, 15, 16 are then marked as defective and are compensated for by means of the respective suitable compensation method, step 90. In contrast, other printing nozzles that likewise exhibit deviations in the nozzle test chart 11 and would have been marked as defective/missing nozzles without the definition of thresholds will be ignored.

Furthermore, in accordance with a particularly preferred embodiment, it makes sense to implement the method of the invention in the form of a software-automated process with the aid of a wizard. This automated process is typically implemented within the framework of a general substrate/print setting qualification phase. In such a qualification phase, parameters such as the maximum ink amount in the solid tone area and settings for drying the ink are defined. If all parameters that determine the ink flow characteristics have been defined in this process, the method of the invention for determining the thresholds 19 by means of the area coverage element 10 and nozzle test chart 11 may be carried out. In this process, a sequence of images is printed. The first images that are printed are the nozzle test charts 11 with the n printing nozzles with preceding nozzle stress areas. For instance, 50 mm nozzle stress areas+5 mm free+80 mm nozzle chart+5 mm free=140 mm. In this process, the nozzle test charts 11 are processed using the algorithm for determining the nozzle parameters. In more concrete terms, it is the deviation of the nozzles from the target position and the continuity of the nozzle that are evaluated. The measured values per criterion are used to determine guideline values of the nozzle parameters per nozzle. These guideline values repress the measuring noise of the image recording and analysis to determine a more accurate parameter value. The tone value areas of the area coverage element 10 are printed behind the charts. The preferred area coverage that is used is 50% because a 50% area is most sensitive to problematic nozzles both in terms of the human eye and in terms of image analysis. Like the standard nozzle test charts 11, the tone value area block includes preceding nozzle stress areas and pixel-to-nozzle allocation points. These are printed circles/discs whose center/focal point is printed by a defined nozzle, allowing precisely the camera pixel at the focal point of the printed element to be allocated to the nozzle by means of image analysis methods. A regular nozzle block may optionally be printed in front of the tone value block to obtain the best prompt correlation between the tone value block and a nozzle chart. 10 mm+10 mm+50 mm+50 mm=120 mm for the tone value element, 140 mm*3+120 mm=540 mm for the optional tone value element with 3 prompt chart blocks. Then a typical gray value intensity is determined in the tone value element in the camera image. Then deviations from this intensity define potential areas with typographic problems. The camera pixels at these locations are correlated with a specific nozzle with the aid of the camera pixels for nozzle allocation. Now the nozzle parameters of all detected nozzles are made available for a threshold process. The process may define a range of nozzle deviation from the target position or a simple average of all nozzle position deviations from the target position as the threshold 19. In this context it is important for the parameters to occur under precisely the printing conditions that have been defined in the substrate qualification process. The defined values 19 are saved in a software database. In a standard printing operation, i.e. in the production run, a customer's print job is printed. The workflow software, i.e. the pre-print software plus the printing machine 7 software, ensures that the typographic settings that have been defined for the customer's job are actually applied. The actual thresholds 19 or ranges for analyzing the 1-N nozzle test charts 11 are likewise applied.

The following is a summary list of reference numerals and the corresponding structure used in the above description of the invention:

1 feeder
2 printing substrate
3 delivery
4 ink jet printing unit
5 ink jet print head
6 computer
7 ink jet printing machine
8 entire print
9 white line
10 area coverage element
11 nozzle test chart
12 black line
13 image artifact resulting from reduced ink application
14 failed printing nozzle
15 printing nozzle with a deviating print dot
16 printing nozzle jetting a reduced amount of ink
17 recorded digital nozzle test chart
18 recorded digital area coverage element
19 calculated thresholds

The invention claimed is:

1. A method for detecting defective printing nozzles in an inkjet printing machine having a computer, which method comprises the steps of:

printing a multi-row nozzle test chart for detection purposes, the multi-row nozzle test chart having a specified number of horizontal rows of equidistant vertical lines printed periodically and disposed underneath one another, wherein in every row of the multi-row nozzle test chart periodically only respective printing nozzles of a print head of the inkjet printing machine contribute to a first element of the multi-row nozzle test chart that correspond to the specified number of the horizontal rows;

printing an area coverage element in such a way that the area coverage element is geometrically associated with the multi-row nozzle test chart, with the printed area coverage element having the same width as the multi-row nozzle test chart and the area coverage element and multi-row nozzle test chart being printed immediately one after another on the printing substrate, and such that every equidistant vertical line of the nozzle test chart element printed by a single nozzle is allocated to a specific region in the area coverage element;

recording both the area coverage element and the multi-row nozzle test chart by means of at least one image sensor;

evaluating both the area coverage element and the multi-row nozzle test chart by means of the computer;

identifying the defective printing nozzles by evaluating a recorded nozzle test chart by means of the computer;

allocating defects in the area coverage element to the printing nozzles in the multi-row nozzle test chart by means of the computer, evaluating parameters of allocated printing nozzles in the nozzle test chart as a function of the defects in the area coverage element by means of the computer, the parameters defining a range of values from which the computer derives thresholds for every allocated printing nozzle; and using the thresholds for detecting the defective printing nozzles, wherein an allocation of detected defects in the area coverage element by means of the computer is achieved on a basis of deviations at a corresponding location transverse to a printing direction in the multi-row nozzle test chart, wherein the printing nozzles in the multi-row nozzle test chart that are allocated to the detected defects are always those that, under consideration of the parameters to be evaluated, are most likely to cause the defect.

2. The method according to claim 1, wherein the steps of printing and evaluating the area coverage elements are only carried out to calculate the thresholds during a set-up phase of the inkjet printing machine, whereas during a subsequent production run of the inkjet printing machine, only the multi-row nozzle test chart is printed and evaluated by the computer based on an application of the thresholds calculated.

3. The method according to claim 1, wherein evaluated parameters of the allocated printing nozzles from which the computer defines the range of values contain an extent of a deviation of a line from a target position of the printing nozzle and/or a continuity of the equidistant vertical line printed periodically.

4. The method according to claims 1, wherein in a direction transverse to the printing direction, the printed area coverage element has a same width as the multi-row nozzle test chart and is printed underneath or above the multi-row nozzle test chart in the printing direction.

5. The method according to claim 1, wherein a calculation of the thresholds for detecting the defective printing nozzles is carried out individually for qualified printing conditions such as a drying behavior of inks that are used and/or a flow behavior of ink on a sprinting substrate, as well as for specific settings of the inkjet printing machine.

6. The method according to claim 5, wherein the thresholds calculated for detecting the defective printing nozzles are saved for a specific qualified printing conditions and settings of the inkjet printing machine in a database that the computer may access.

7. The method according to claim 1, wherein the method is run by a software qualification tool that is active on the computer and, in a qualification phase, configures a substrate and print settings for a print job on the inkjet printing machine.

8. The method according to claim 1, wherein the defective printing nozzles of the inkjet printing machine are compensated for by a corresponding actuation of the inkjet printing machine.

9. A method for detecting defective printing nozzles in an inkjet printing machine having a computer, which method comprises the steps of:

printing a multi-row nozzle test chart for detection purposes, the multi-row nozzle test chart having a specified number of horizontal rows of equidistant vertical lines printed periodically and disposed underneath one another, wherein in every row of the multi-row nozzle test chart periodically only respective printing nozzles of a print head of the inkjet printing machine contribute to a first element of the multi-row nozzle test chart that correspond to the specified number of the horizontal rows;

printing an area coverage element in such a way that the area coverage element and the multi-row nozzle test chart are geometrically positioned relative to one another, with the printed area coverage element having the same width as the multi-row nozzle test chart and the area coverage element and multi-row nozzle test chart being printed immediately one after another on the printing substrate, and such that every equidistant vertical line of the nozzle test chart element printed by a single nozzle is allocated to a specific region in the area coverage element;

recording both the area coverage element and the multi-row nozzle test chart by means of at least one image sensor;

evaluating both the area coverage element and the multi-row nozzle test chart by means of the computer;

identifying the defective printing nozzles by evaluating a recorded nozzle test chart by means of the computer;

allocating defects in the area coverage element to the printing nozzles in the multi-row nozzle test chart by means of the computer, evaluating parameters of allocated printing nozzles in the nozzle test chart as a function of the defects in the area coverage element by means of the computer, the parameters defining a range of values from which the computer derives thresholds for every allocated printing nozzle; and using the thresholds for detecting the defective printing nozzles, wherein an allocation of detected defects in the area coverage element by means of the computer is achieved on a basis of deviations at a corresponding location transverse to a printing direction in the multi-row nozzle test chart, wherein the printing nozzles in the multi-row nozzle test chart that are allocated to the detected defects are always those that, under consideration of the parameters to be evaluated, are most likely to cause the defect.

* * * * *